United States Patent [19]

Hughes

[11] Patent Number: 4,641,831

[45] Date of Patent: Feb. 10, 1987

[54] ROTATING AMUSEMENT DEVICE HAVING MOTION GOVERNOR

[75] Inventor: David C. Hughes, South Hadley, Mass.

[73] Assignee: Milton Bradley Company, East Longmeadow, Mass.

[21] Appl. No.: 775,631

[22] Filed: Sep. 13, 1985

Related U.S. Application Data

[63] Continuation-in-part of Ser. No. 525,140, Aug. 22, 1983, abandoned.

[51] Int. Cl.[4] ..... A63H 13/20

[52] U.S. Cl. ..... 272/31 R; 267/122; 188/298; 74/411.5; 40/474; 40/415; 446/236; 446/197

[58] Field of Search ..... 446/330, 358, 357, 352, 446/355, 359, 334, 268, 236, 303, 197, 180; 272/31 R, 31 A, 31 B; 267/122, 123, 64.27; 188/298, 322.17, 85; 74/411.5, 18.2; 40/474, 415, 414

[56] References Cited

U.S. PATENT DOCUMENTS

| | | | |
|---|---|---|---|
| 535,896 | 3/1895 | Fritsche | 446/334 |
| 1,998,270 | 4/1935 | Cheetham | 446/236 |
| 2,818,678 | 1/1958 | Lemelson | 446/303 X |

*Primary Examiner*—Mickey Yu

*Attorney, Agent, or Firm*—Ross, Ross & Flavin

[57] ABSTRACT

Apparatus for controlling rotary motion wherein a bellows is fixed at one end to a support having a restricted vent opening and carries a crank at its opposite end linked to a stallable type motor, the motor moving the crank in a circular path controlled by the bellows between alternate fast and slow motion according to the change in length of the bellows.

2 Claims, 7 Drawing Figures

ROTATING AMUSEMENT DEVICE HAVING MOTION GOVERNOR

This is a continuation-in-part of application Ser. No. 06/525,140 filed Aug. 22, 1983 now abandoned.

This invention relates to a bellows-type mechanism for controlling rotary motion.

One object hereof is to provide an inexpensive mechanism for controlling alternate fast and slow motions, a mechanism being particularly useful in various toy applications.

Another object is to provide such a mechanism wherein myriad novel effects may be obtained by the feature of changing speeds and the acceleration forces thereby developed.

Another object is to provide a relatively longer running time for the operation of a toy or device under its control than would be obtained under other mechanisms having a similar function.

Spring motors in toys have a number of advantages. They are light in weight, have low operating cost and are reliable. One disadvantage, however, is their short running time: typically 1–4 minutes. With the intermittent motion governor however, this action period is greatly extended as much as ten times.

Additionally, the alternation of fast with slow motion is mysterious and generates an air of suspense and excitement.

It should also be noted that the intermittent motion governor can be applied to any stallable motor, such as a wind or water driven, or a sand or marble operated motor.

The intermittent motion governor can be applied to any toy in which a continuous uniform motion is not essential, and will greatly increase the running time thereof as well as add the features of mystery and excitement.

Figure 1:
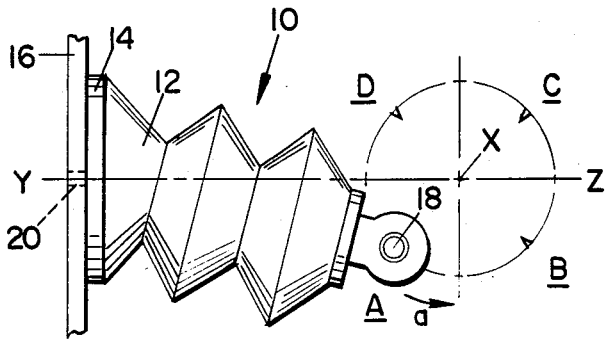
FIGS. 1–4 are schematic representations of an intermittent motion governor embodying one form of the invention and illustrating the steps of its operation through a single operative stroke.
Figure 2:
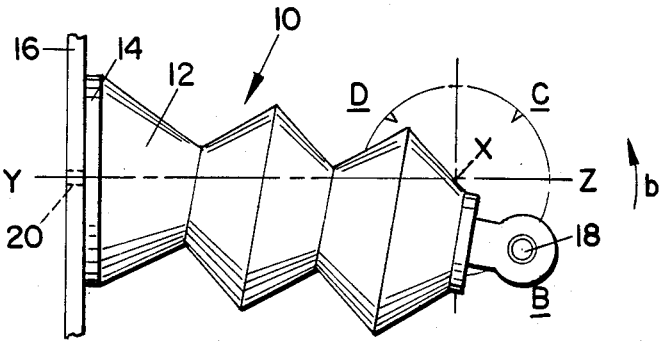

In FIGS. 1–4, an intermittent motion governor is generally indicated by 10 and comprises a bellows 12 having an annular base 14 mounted on a fixed wall or support 16. The opposite end of bellows 12 has a crank 18 operatively connected thereto which crank is driven by a motor (not shown). The motor is of the "stallable" type, such as a spring or weight motor which can readily accommodate to being restrained or held back.

Crank 18 defines a circular path A B C D about a center X, which center is on a line Y Z perpendicular to the center of base 14.

A restricted vent opening 20 of approximately thirteen thousandths of an inch in diameter extends through wall 16 and allows air slowly to enter or to exit the bellows to the end that the bellows length cannot be suddenly changed. It permits a very slow air flow and accordingly a very slow crank movement when the bellows is in either the lengthening or shortening mode.

Operationally, with the motor energized, crank 18 turns in the circular path A B C D about center X. However, as the crank moves from point A to point B in the direction of arrow a (FIG. 1), bellows 12 is substantially lengthened, so as to cause air to be drawn in through restricted opening 20. The opening being small as aforesaid, the crank motion is operative at a very slow speed.

As crank 18 moves from point B to point C, (FIG. 2), its direction of motion, (arrow b), is such that the length of the bellows is substantially unchanged wherefor the crank travels from B to C at a relatively high speed.

Figure 3:
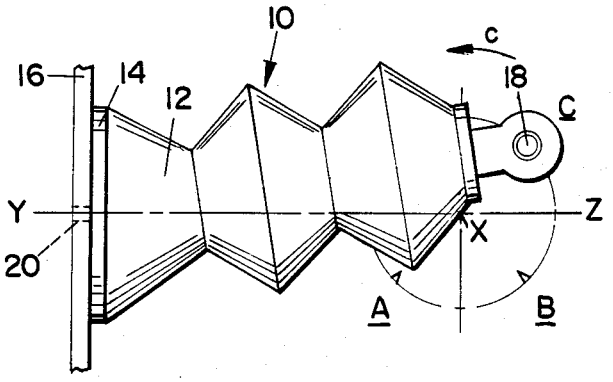
Figure 4:
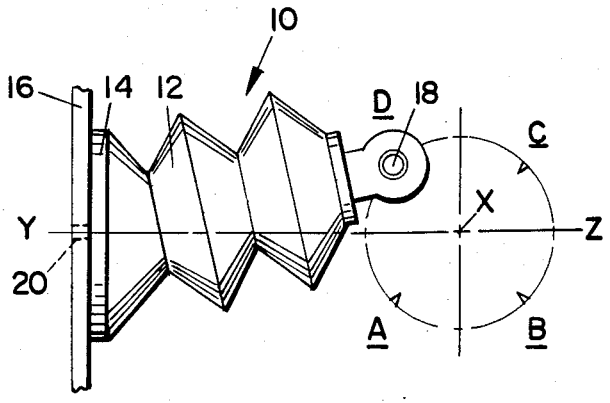

In movement from point C to point D, (arrow c) FIG. 3), the length of bellows 12 is substantially shortened. Air must be expelled through the restricted vent opening 20. Here the crank motion is again operative at a slow speed.

The movement through the final quadrant from point D to point A, (FIG. 4), is traversed at a high speed for the reason again that the crank motion changes the bellows length only slightly.

Restricted vent opening 20 permits the slow flow of air and hence the slow movement of the crank when the bellows is being either lengthened or shortened (i.e. going from A to B or from C to D).

When the crank is moving at right angles to the bellows axis (as in going from B to C or from D to A) there is little resulting change in the bellows length and hence little opposition to the bellows movement. Thus, the crank travels rapidly from point B to point C and from point D to point A.

It is to be stressed that the change in crank speed between the fast and slow portions is extreme and radical and it will be appreciated that with this mechanism, the constant torque of the motor results in alternating very rapid and very slow output motions.

The ratio of fast to slow motion is variable by the moving of the crank off center with respect to the bellows and/or by lengthening the arm interconnecting bellows to crank.

Herewith, the changing rates of motion—first fast—then slow—are more interesting and mysterious, so as to offer an advantage over a simple motor drive of the known art.

Too, the action may be exploited to last many times longer—as much as 20 minutes longer as compared to 30–40 seconds for the same motor without a governor.

Figure 5:
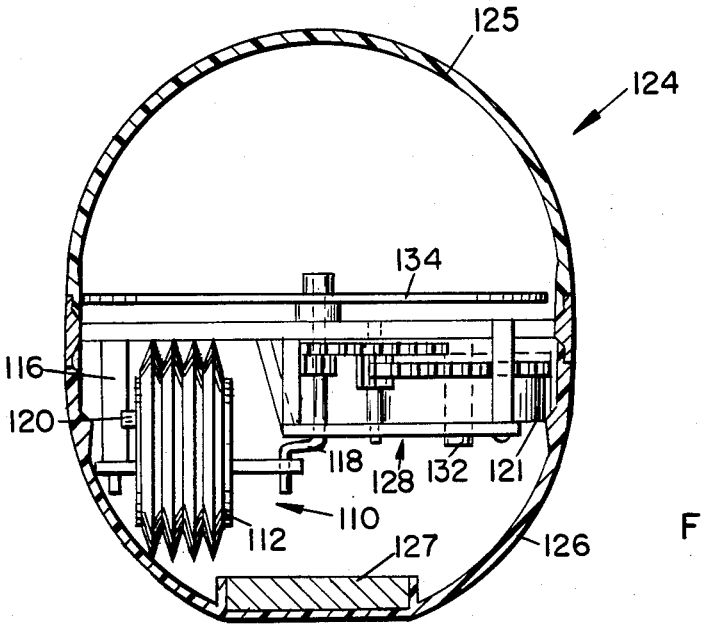
FIG. 5 is a part-sectional side elevational view showing the intermittent motion governor of FIGS. 1–4 as applied to a typical toy.
Figure 6:
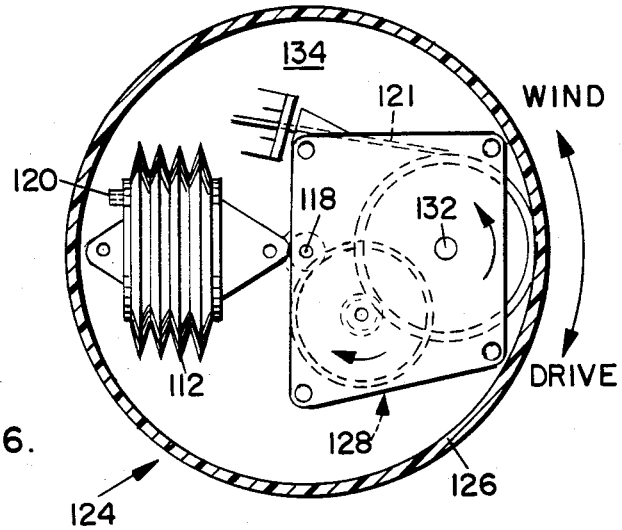
FIG. 6 is a bottom plan view of the FIG. 5 toy.
Figure 7:
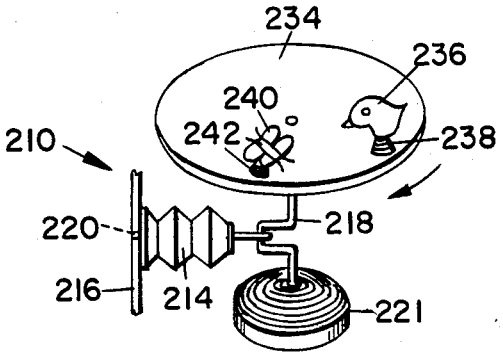
FIG. 7 is a fragmentary perspective view of the toy of FIGS. 5 and 6 in a specific embodiment.

One practical application of the intermittent motion governor of FIGS. 1–4 as applied to a toy is shown in FIGS. 5–7.

With reference first to FIGS. 5 and 6, an intermittent motion governor 110 and its bellows 112 having a restricted vent opening 120 and fixed support 116 are mounted interiorly of a housing 124 in the form of a dome having mating upper and lower half parts 125 and 126 respectively.

The upper half part 125 of the dome is transparent so that the interior thereof is visible. The lower half part 126 may be transparent or opaque as desired. The lower half part may include a weight 127.

Crank 118 of intermittent motion governor 110 is operatively connected to a "stallable" type motor such as a spring motor 121 or weight motor which can accommodate being held back or restrained.

The motor may be wound by a key, not shown, or by turning the upper half part relative to the lower half part.

A motor shaft 132 is operatively connected by a gear train 128 to crank 118.

Crank 118 carries a rotatable disc or turntable 134 at its upper end.

The disc 134 is driven through gear train 128 by motor 121 controlled by bellows governor 110. When the crank 118 receives an impulse push from motor 121 during the "rapid" quadrants of governor 110, the disc 134 turns freely and rapidly.

When the crank 118 receives an impulse push from motor 121 during the "slow" quadrants of governor 110, the disc turns slowly.

A specific embodiment is shown in FIG. 7, and may be enclosed in a dome, not shown, as described in FIGS. 5 and 6. A governor 210 comprising a bellows 214 attached to a fixed support 216 having a restricted vent opening 220 is operatively connected to a crank 218 driven by a spring motor 221.

The upper end of crank 218 carries a disc or turntable 234.

A bird 236 is mounted on the turntable 234 on a flexible spring 238 and in front of the bird is a butterfly 240 similarly mounted on a flexible spring 242.

As the turntable is allowed to turn slowly, the bird appears to be pursuing the butterfly. When the rapid motion occurs the bird appears to lunge forward and peck at the butterfly which narrowly escapes. This action is repeated several times because of the spring mounting. Then the slow pursuit begins again and the sequence is repeated.

I claim:

1. Apparatus for controlling intermittent rotary motion comprising:

a support, a bellows having one end fixed to the support and an opposite free end, the bellows having a longitudinal center line, a restricted vent opening communicating with the bellows, a stallable type motor, a crank operatively connected at one end to the free end of the bellows and at its opposite end to the motor, a turntable operatively connected to the crank, the crank being driven by the motor and describing with the free end of the bellows a circular path about a center on a line perpendicular to the center line of the bellows, actuation of the crank by the motor effecting slow movement of the crank through certain segments of the circular path and concomitant slow rotative movement of the turntable as air slowly enters into and exits from the bellows through the restricted vent opening as the length of the bellows is alternately lengthened and shortened, further actuation of the crank by the motor effecting rapid movement of the crank through certain other segments of the circular path and concomitant rapid rotative movement of the turntable as the length of the bellows remains substantially constant.

2. Apparatus according to claim 1 wherein the turntable carries spring-mounted figures on its upper surface.

* * * * *